US008331809B2

(12) United States Patent
Lu et al.

(10) Patent No.: US 8,331,809 B2
(45) Date of Patent: Dec. 11, 2012

(54) CURRENT MONITORING TO DETECT PHOTORECEPTOR SCRATCHES

(75) Inventors: Michael Quoc Lu, Fairport, NY (US); Bruce E. Thayer, Spencerport, NY (US); John R. Uchal, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 361 days.

(21) Appl. No.: 12/833,051

(22) Filed: Jul. 9, 2010

(65) Prior Publication Data

US 2012/0008965 A1 Jan. 12, 2012

(51) Int. Cl.
*G03G 15/00* (2006.01)

(52) U.S. Cl. ..... 399/26

(58) Field of Classification Search ..... 399/24, 399/26, 31, 71, 159, 175, 353, 354; 324/71.1, 324/71.2

See application file for complete search history.

(56) References Cited

U.S. PATENT DOCUMENTS

| | | | | |
|---|---|---|---|---|
| 5,101,159 | A * | 3/1992 | Bossard et al. | 324/456 |
| 6,738,585 | B2 * | 5/2004 | Shin et al. | 399/26 |
| 7,272,330 | B2 * | 9/2007 | Harlan et al. | 399/26 |
| 7,693,433 | B2 * | 4/2010 | Ohmori et al. | 399/26 |
| 7,783,212 | B2 * | 8/2010 | Ichikawa et al. | 399/48 |
| 7,907,854 | B2 * | 3/2011 | Shima | 399/26 |
| 2004/0057762 | A1 | 3/2004 | Thayer | |
| 2007/0014607 | A1 | 1/2007 | Pozniakas | |
| 2007/0140720 | A1 | 6/2007 | Lu et al. | |
| 2008/0069586 | A1 | 3/2008 | Danglemaier et al. | |
| 2010/0014883 | A1 | 1/2010 | Thayer et al. | |
| 2010/0046997 | A1 | 2/2010 | Gross et al. | |
| 2011/0286753 | A1 * | 11/2011 | Paul et al. | 399/26 |
| 2012/0062208 | A1 * | 3/2012 | Ohshima | 324/72 |

FOREIGN PATENT DOCUMENTS

| | | | |
|---|---|---|---|
| JP | 2000029282 A | * | 1/2000 |
| JP | 2000146920 A | * | 5/2000 |
| JP | 2002365984 A | * | 12/2002 |

* cited by examiner

*Primary Examiner* — Robert Beatty
(74) *Attorney, Agent, or Firm* — Gibb & Riley, LLC

(57) ABSTRACT

A method monitors an electric current supplied to an electrostatic brush within a printing device. The electrostatic brush contacts and cleans a photoreceptor surface within the printing device. The method records a current spike pattern of when the electric current exceeds a first current threshold during the monitoring; however, the method will stop operations of the printing device if the electric current exceeds a second current threshold that is greater than the first current threshold. Further, the method can determine whether a scratch is present on the photoreceptor surface based on the current spike pattern.

20 Claims, 5 Drawing Sheets

CURRENT MONITORING TO DETECT PHOTORECEPTOR SCRATCHES

BACKGROUND

Embodiments herein generally relate to printing devices and their control systems, and more particularly to methods and systems that monitor the current supplied to an electrostatic brush during operation to detect scratches on a photoreceptor.

Photoreceptors are vulnerable to being abraded or scratched during handling (e.g., install of photoreceptor or other components) or printing (e.g., contacting components such as cleaning blades and/or electrostatic brushes). The abrasion or scratch level on a photoreceptor can be hard to assess or detect visually by the unaided human eye, especially if the lighting conditions are not optimal. Further, on many printing devices, it may be difficult to maneuver around a photoreceptor belt mounted on the photoreceptor module to search for the scratches. It is not uncommon for an operator to remove the photoreceptor belt to troubleshoot a printing machine. Unfortunately, this greatly increases the likelihood of further damaging the photoreceptor belt (i.e., inducing a scratch).

SUMMARY

In view of the foregoing, the embodiments herein provide a method and system for detecting photoreceptor scratches with minimal operator contact, in order to avoid generating further damage. More specifically, the embodiments herein monitor the current supplied to an electrostatic brush during operation to detect scratches on a photoreceptor.

A conductive ground plane is beneath the photoconductive layers of the photoreceptor. If an abrasion or a scratch is severe enough to expose the ground plane, the biased conductive brush fibers can short to the ground plane of the photoreceptor. If enough of the ground plane is exposed, this can even trigger an electrostatic brush power supply over current fault. By monitoring electrostatic brush current spikes below the power supply limit, the embodiments herein determine the current threshold that causes objectionable print defects and distinguishes between those current spikes that are due to photoreceptor scratches and those that are due to cleaner housing shorting (e.g., carrier beads, loose brush fibers). This information reduces diagnostic time, unnecessary repair, and incorrect replacement due to misdiagnoses. With embodiments herein, service cost is reduced and printer up time is increased.

One exemplary embodiment comprises a method that monitors an electric current supplied to an electrostatic brush within a printing device. The electrostatic brush contacts and cleans a photoreceptor surface within the printing device. The electrostatic brush comprises electrically conductive brush fibers or electrically conductive magnetic particles connected to a power supply and the monitoring process measures the electric current supplied by the power supply to the electrically conductive brush fibers.

The method records a current spike pattern of when the electric current exceeds a first current threshold during the monitoring; however, the method will stop operations of the printing device if the electric current exceeds a second current threshold that is greater than the first current threshold.

Further, the method can determine whether a scratch is present on the photoreceptor surface based on the current spike pattern. For example, the method can determine whether an electrical short exists between the electrostatic brush and the photoreceptor surface, or whether an electrical short exists between the electrostatic brush and the cleaner housing based on whether the current spike pattern is cyclical or random.

For example, the photoreceptor surface comprises an underlying ground plane that conducts the electric current from the electrostatic brush if the scratch is present on the photoreceptor surface. The ground plane conducts the electric current from the electrostatic brush if the scratch extends through the photoreceptor surface to the underlying ground plane, thereby producing a cyclical current spike pattern as the photoreceptor belt or roll regularly passes by the electrostatic brush.

In addition, the method can periodically observe print quality if the electric current exceeds the first current threshold. Then, the method can adjust the first current threshold depending upon whether the print quality is affected when the electric current exceeds the first current threshold.

A printing device embodiment herein comprises a media supply storing sheets of media, a media path connected to the media supply, and a printing engine within the media path. The media path supplies the sheets of media from the media supply to the printing engine. The printing engine comprises a photoreceptor having a photoreceptor surface and an electrostatic brush that contacts and cleans the photoreceptor surface. At an output at an end of the media path, printed sheets of media comprising markings generated by the printing engine are delivered.

A processor is operatively connected to the media path and the printing engine. The processor controls the printing engine to create the markings on the printed sheets of media. Further, the processor monitors the electric current being supplied to the electrostatic cleaner and records a current spike pattern of when the electric current exceeds a first current threshold during the monitoring. As shown above, the processor can stop operations of the printing engine if the electric current exceeds a second current threshold that is greater than the first current threshold during the monitoring. The processor determines whether a scratch is present on the photoreceptor surface based on the current spike pattern.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
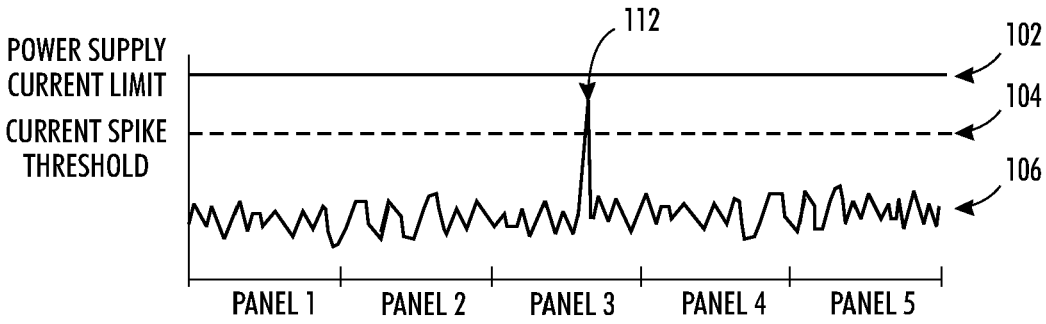
FIG. 1 is a graph illustrating current drawn by an electrostatic brush according to embodiments herein.

As mentioned above, it is easy to scratch a photoreceptor, but it is difficult to detect when a photoreceptor has been scratched. Some systems monitor the current draw from the conductive brushes in electrostatic brush cleaner systems during operation to predict incoming toner rates. This information can be used in control algorithms to detect low area coverage (LAC) runs which allow adjustments to the electrostatic brush cleaner system parameters and reduce the operating power consumption of the printer.

The embodiments herein monitor the electrostatic brush (ESB) current draw and detect the occurrence of spikes in this signal. A spike can be caused by scratches in the photoreceptor belt. Further, the embodiments herein distinguish between electrostatic brush power supply over current faults due to photoreceptor scratches and those due to cleaner housing shorting.

Electrostatic brush power supply over current faults can be generated by either a short in the cleaner housing or a photoreceptor surface scratch that exposes enough of the photoreceptor ground plane to the biased brush fibers (if such shorts exceed the electrostatic brush power supply current limit). Electrostatic brush cleaner housings can short due to a buildup of carrier beads within the housing or due to loose brush fibers or other conductors bridging a gap between biased cleaner housing surfaces.

For example, the cleaner housing gap may be between the biased cleaner housing and the photoreceptor ground strip, the grounded machine frame, or between portions of the cleaner housing biased to different levels. Conventionally, there was no quick diagnostic procedure to distinguish between an electrostatic brush cleaner housing short and a brush to photoreceptor scratch short.

Therefore, the embodiments herein identify the cause of the electrostatic brush power supply short by distinguishing between a conductive path in the cleaner housing, and one in the deep scratch in the photoreceptor. Electrostatic brush cleaner housing shorts are difficult to find visually because they are often disturbed when the machine is opened up to inspect the cleaner. Conductive material that builds up in the housing can be dislodged, making diagnosis speculative if not impossible. In many cases, because photoreceptor scratches can be difficult to find, the photoreceptor will be incorrectly replaced simply because no cleaner housing short was found. The conductive materials or their source may still be present, resulting in a reoccurrence of the cleaner housing shorting a relatively short time after the end of service for the fault.

Conductive coatings can be "burned" off of the brush fiber tips or toner fused to the fiber tips by the higher current at the photoreceptor scratch. Although the electrostatic brush power supply over current fault is avoided, the brush no longer cleans around its circumference at the location of the photoreceptor scratch. This eventually leads to print defects (streaks and bands) and machine contamination at the location of the photoreceptor scratch. The embodiments herein are capable of detecting these scratches and alerting the machine operator to the need for a photoreceptor replacement even though the current draw through the scratch does not exceed the electrostatic brush power supply current limit.

As shown in FIG. 1, one feature of embodiments herein is the establishment of an electrostatic brush current spike threshold 104 at a lower magnitude than the current limit for the electrostatic brush power supply 102. The current drawn by (supplied to) the electrostatic brush is shown as line 106 in FIG. 1. The electrostatic brush power supply current limit 102 is used to generate an electrostatic brush power supply over current fault and to shut down machine operation. The current spike threshold 104 is used to diagnose photoreceptor scratches and distinguish them from electrostatic brush cleaner housing shorting.

Operation of the electrostatic brush at current levels higher than the current spike threshold 104, but below the power supply current limit 102 (shown as exemplary current spike 112 in FIG. 1) may or may not result in print defects or damage to machine components. If the current spike is due to a small scratch in the photoreceptor surface, the brush bias may drop slightly, but may not be enough to generate a cleaning defect on prints. Over time however, the additional current passing from the brush fiber tips to the photoreceptor ground plane, exposed by the scratch, may damage the brush fibers or enlarge the scratch.

A cleaner housing short would not be expected to appear as a current spike, or at least not as a regularly recurring cyclical current spike. The buildup of conductive material between two biased housing surfaces or a biased housing surface and ground would result in a more or less constant high current level. If the conductive material builds up and is subsequently disturbed, the high current may be cyclical but it will still be more constant than a current spike caused by a photoreceptor scratch.

Figure 2:
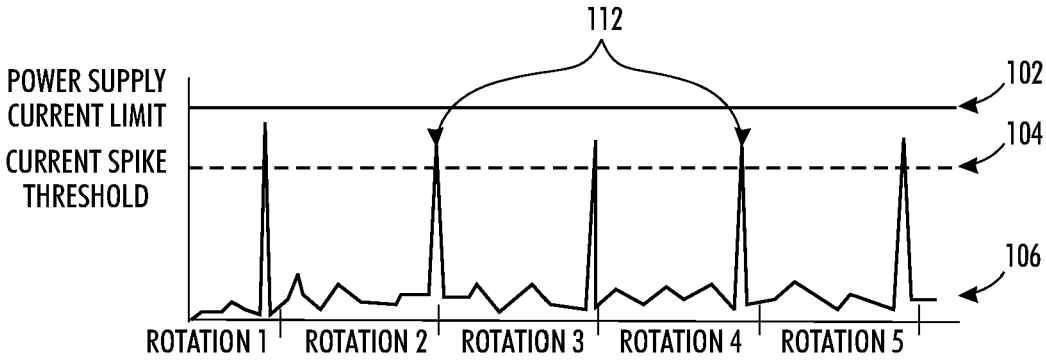
FIG. 2 is a graph illustrating current drawn by an electrostatic brush according to embodiments herein.

Electrostatic brush current spikes caused by photoreceptor scratches will reoccur at regular intervals (will be cyclical) as the scratched portion of the photoreceptor repeatedly passes through the brush nip, as shown in FIG. 2. More specifically, FIG. 2 illustrates multiple rotations of a photoreceptor (roll or belt) during which, near the end of the rotation, a current spike 112 that is greater than the threshold 104, but less than the current limit 102 is detected. Thus, FIG. 2 illustrates a situation where a current spike above the threshold occurs at approximately the same point in each rotation cycle.

Figure 3:
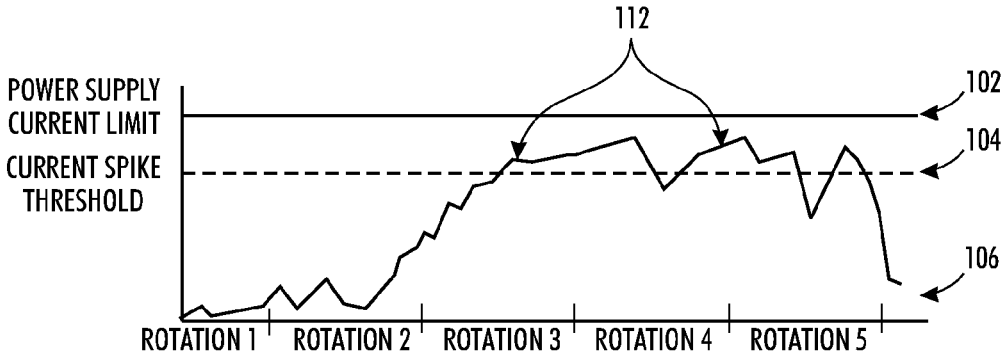
FIG. 3 is a graph illustrating current drawn by an electrostatic brush according to embodiments herein.

The current spikes 112 in FIG. 2 may not all have the same magnitude and may not occur on every pass through the brush nip, especially if the scratch is small; however the current spikes will be cyclical (and not random). Random current spikes 112 occurring at different points within different rotational cycles are illustrated in FIG. 3. Therefore, the regular, cyclical current spikes shown in FIG. 2 would be identified by embodiments herein as indicating a photoreceptor scratch, while the irregular nonrandom current spike shown in FIG. 3 would indicate a different form of short (e.g., shorting to the housing).

The degree to which the spikes must comply with a "regularity standard" will vary depending upon the type of marking material (toner) used and the type of photoreceptor used. Therefore, one standard of regularity could require that a spike occur at the same point in every rotation, while a different standard of regularity could require that the spike occur at the same point in, for example at least 3 of 10 rotations. Similarly, the consistency of the "point" at which the spikes occur within the rotational cycle of the photoreceptor can also vary depending upon the specific implementation. For example, the point can be required to be within 1% of other points, or the standard can be adjusted to 5%, 10%, 25%, etc. Essentially, depending upon the specific device in question, the embodiments herein can be adjusted to identify what is considered to be a cyclical, recurring (nonrandom) spike pattern to accommodate any engineering goal, so long as cyclical spikes can be consistently differentiated from random spikes to distinguish between photoreceptor scratches and other potential shorts.

The embodiments herein can also identify the approximate location of the scratch by correlating the location of the current spike within the rotational cycle to a distance from a known point on the photoreceptor. The ground plane conducts the electric current from the electrostatic brush if the scratch extends through the photoreceptor surface to the underlying ground plane, thereby producing a cyclical current spike pattern as the photoreceptor belt or roll regularly passes by the electrostatic brush.

Therefore, for example, if the belt is known to be 1 m long and the rotations are measured from the beginning of the belt, if a spike is regularly occurring at 90% of the belt rotation, the scratch will be at a location approximately 0.9 m from the beginning of the belt. Similarly, as shown in FIG. 1, the current spike 112 can be identified as being near the center of an identified part (e.g., panel 3) of the photoreceptor. The embodiments herein record the location as the distance (e.g., mm, seconds, clock pulses, degrees) past a reference location on the photoreceptor (e.g., belt hole, seam). If the current spike in FIG. 1 continues to occur at the same location (e.g., Panel 3) on every cycle (or a predetermined percentage of cycles) of the photoreceptor revolutions, then the embodiments herein associate the current spike with a scratch at that location of the photoreceptor.

Also, the orientation of the scratch will influence the magnitude and duration of the current spike. A 30 mm long scratch oriented across the process direction will have more ground plane exposed when traveling through a 10 mm brush nip than a 30 mm long scratch oriented in the process direction. The scratch in the process direction will have a current spike of longer duration and smaller magnitude than the scratch oriented across the process direction.

Figure 4:
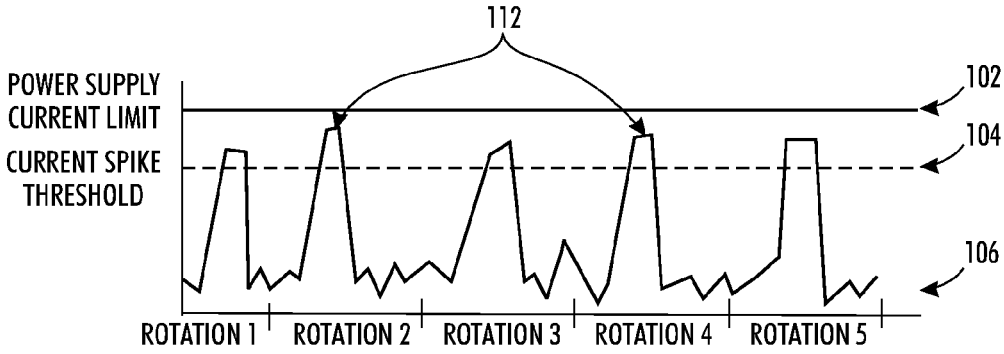
FIG. 4 is a graph illustrating current drawn by an electrostatic brush according to embodiments herein.

This is shown when the spikes 112 in FIG. 2 are compared with the spikes 112 shown in FIG. 4. FIG. 2 illustrates relatively brief current spikes 112, which the embodiments herein would identify as a scratch that is oriented across (at an angle to) the process direction. To the contrary, FIG. 4 illustrates relatively longer current spikes 112, which the embodiments herein would identify as a scratch that is oriented in the process direction.

Thus, the current spike 112 will have two components, a magnitude and duration. The duration limit is useful to distinguish a photoreceptor scratch current spike from a wider high current event due to cleaner housing shorting. The magnitude of the threshold can be tuned for particular job requirements and some embodiments herein provide the user an option to adjust the magnitude and duration limits. Thus, by using embodiments herein, a customer is able to select a threshold to match the print quality requirements of particular jobs. For jobs demanding the highest quality printing, a low threshold magnitude would be selected and any photoreceptor scratches deep enough to create current spikes would probably result in replacement of the photoreceptor. For jobs with low print quality requirements a high threshold magnitude can be selected and some of the photoreceptors rejected for high quality printing jobs could be successfully used.

Therefore, as shown in FIGS. 2 and 4, the embodiments herein observe the pattern of current spikes 112 that occur between the threshold 104 and the limit 102 to identify whether a scratch is present on the photoreceptor, the approximate location of the scratch on the photoreceptor, and the approximate orientation of the scratch. This information is provided to the user by the embodiments herein to help the user identify the scratch and to allow the scratch to be evaluated for severity. This helps the user make a determination as to whether the photoreceptor needs to be replaced.

Figure 5:
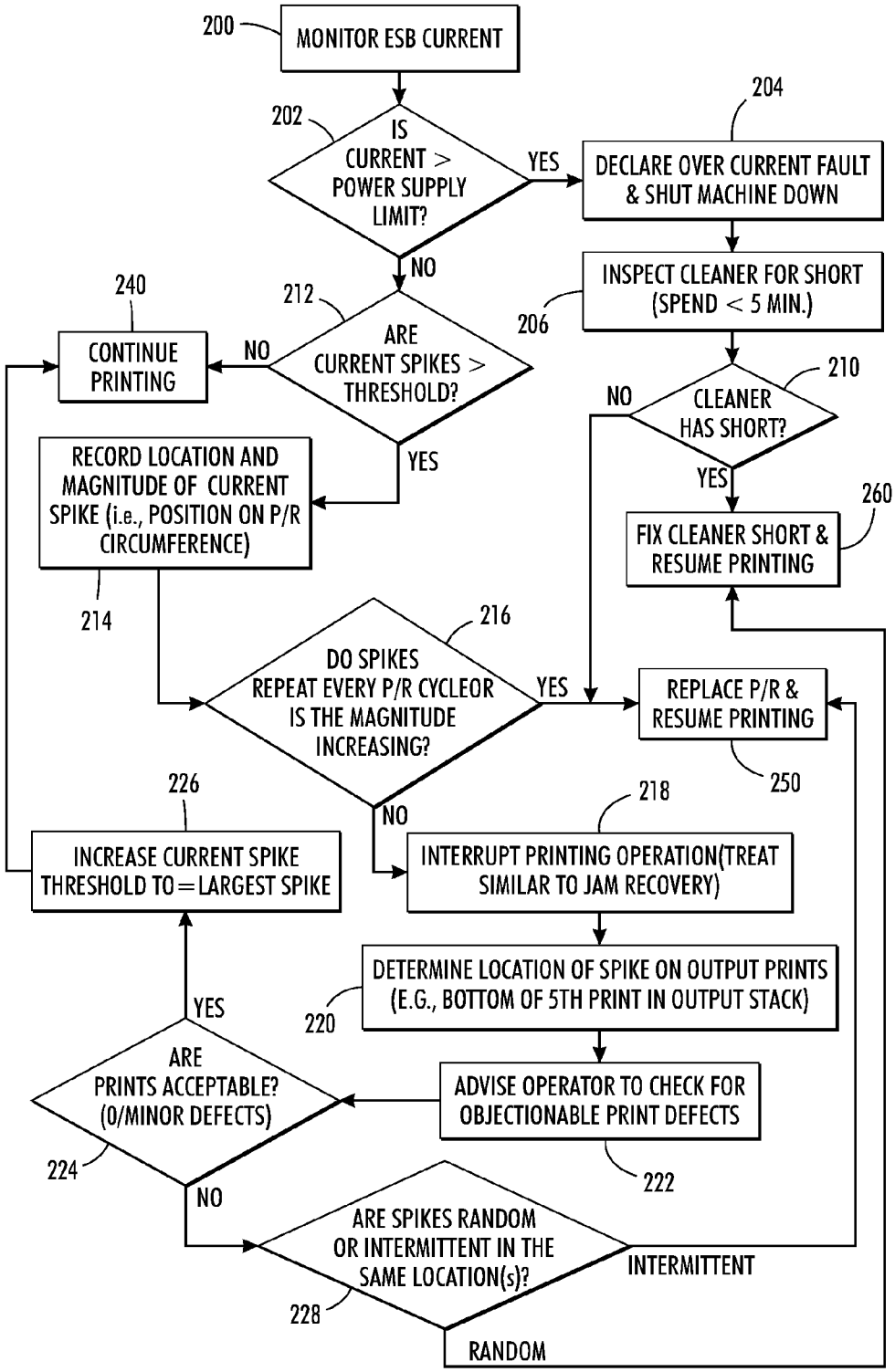
FIG. 5 is a flow diagram illustrating method embodiments herein.

The flow chart in FIG. 5 describes how monitoring the brush current can lead to identifying a scratched/abraded photoreceptor belt that may lead to image quality print defects and identifying the photoreceptor belt as a potential culprit that can cause cleaner subsystem electrical shorts. In item 200, the methods herein monitor an electric current supplied to an electrostatic brush within a printing device. The electrostatic brush contacts and cleans the photoreceptor surface within the printing device. The electrostatic brush comprises electrically conductive brush fibers connected to a power supply, and the monitoring process in item 200 measures the electric current supplied by the power supply to the electrically conductive brush fibers.

In item 202, the method determines whether the current drawn exceeds the power supply limit. If it does, in item 204, a message is presented through the graphic user interface of the printing device that an over current fault situation has occurred and the machine is shut down. The user then inspects the cleaner for any type of short in item 206. If the cleaner has a short, the solution to the problem is to fix the cleaner short and resume printing, as shown in item 260. Otherwise, if there is not a cleaner short, the process requires that the photoreceptor be replaced, and printing is resumed, as shown in item 250.

If, in item 202, the current does not exceed the power supply limit, in item 212, the methods herein determine whether there are any current spikes that are above the current spike threshold. If not, normal printing processes are continued as shown in item 240. However, if the current does exceed the threshold, in item 214, the methods record the current spike pattern.

The method can determine whether a scratch is present on the photoreceptor surface based on the current spike pattern. For example, the method can determine whether an electrical short exists between the electrostatic brush and the photoreceptor surface, or whether an electrical short exists between the electrostatic brush and the cleaner housing based on whether the current spike pattern is cyclical or random. Therefore, in item 216, the embodiments herein determine whether the spikes repeat on every photoreceptor cycle and determine whether the magnitude of the spikes is increasing. If so, in item 250, the photoreceptor is replaced and printing is resumed.

If the spikes do not repeat on every cycle, or if they are not increasing, in item 218, the embodiments herein interrupt the printing operation (in a similar manner as would be done for a jam recovery operation). The location of the spike within the output prints is determined by correlating the timing of when the spike occurred to a sheet of media that was being printed at that time (e.g., bottom of fifth print in output stack) in item 220. Then, in item 222, the message is provided on the graphic user interface of the printing device to advise the operator to check for objectionable print defects at that location. In item 224, if the print is not acceptable, processing proceeds to item 228 to determine whether the spikes are random or whether they are intermittent, but occurring in the same location.

If the spikes are determined to be random in item 228, processing proceeds to item 260 where the cleaner short is fixed and printing is resumed. If the spikes are intermittent, this indicates that the scratches are on the photoreceptor and the photoreceptor is replaced and printing is resumed in item 250.

Thus, the methods periodically observe print quality if the electric current exceeds the first current threshold in item 224. Then, the method can adjust the first current threshold depending upon whether the print quality is affected when the electric current exceeds the first current threshold. More specifically, as shown in item 226, the current spike threshold is increased to be greater than or equal the largest spike that occurred which did not cause objectionable prints and processing returns to item 240 to continue printing. In this way, the current spike threshold can be continually adjusted to accommodate the image quality level required by the user.

Figure 6:
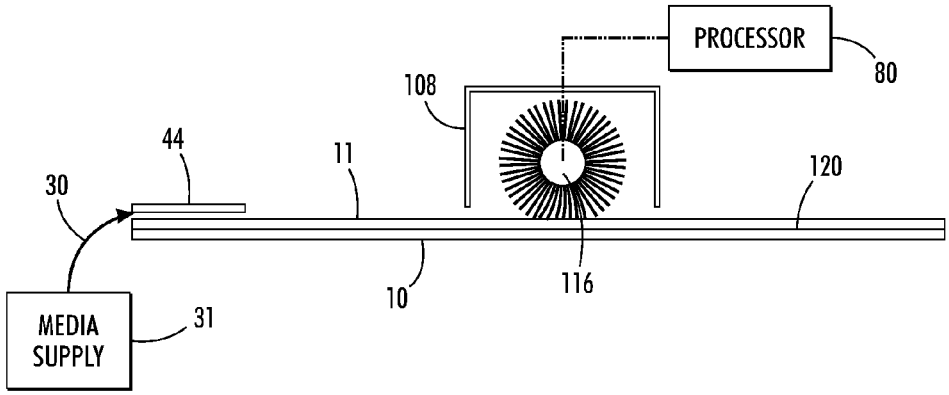
FIG. 6 is a side-view schematic diagram of an electrostatic cleaning device according to embodiments herein.
Figure 9:
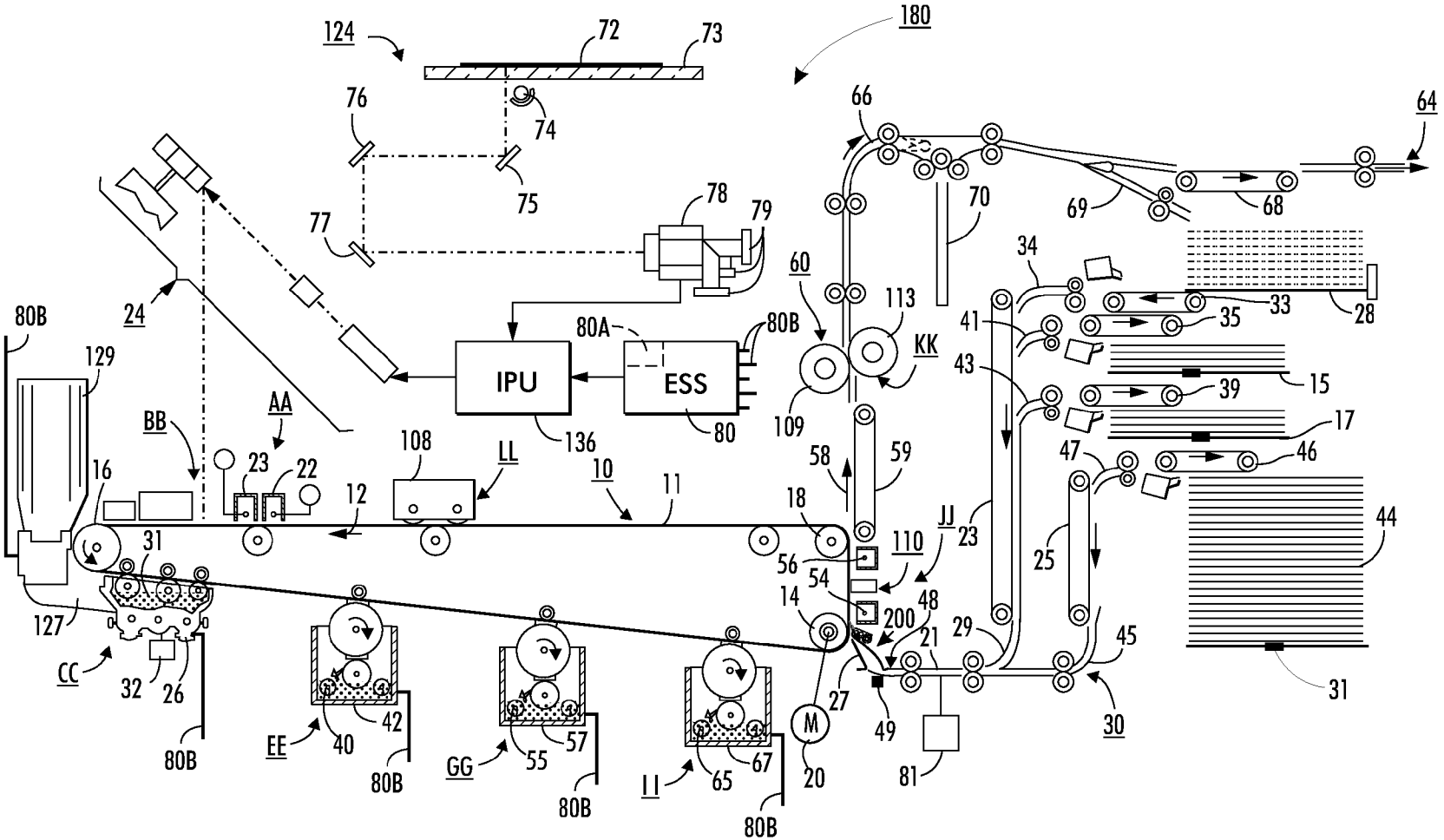
FIG. 9 is a side-view schematic diagram of a printing device according to embodiments herein.

A more generalized printing device herein is shown in FIG. 9 and is discussed below; however, portions of the printing device are illustrated in FIG. 6. More specifically, FIG. 6 illustrates a media supply 31 storing sheets of media 44, a media path 30 connected to the media supply 31, and a printing engine (FIG. 9) within the media path 30. The media path 30 supplies the sheets of media 44 from the media supply 31 to the printing engine. The printing engine comprises a photoreceptor 10 having a photoreceptor surface 11 and a ground plane 120. The electrostatic cleaner, shown in FIG. 9 as item LL, includes a housing 108 and an electrostatic brush 116 that contacts and cleans the photoreceptor surface 11. Alternatively, the electrostatic brush could also be a static conductive brush used as a sensor for photoreceptor scratches in, for example, a machine with a blade cleaner.

A processor 80 is operatively connected to the media path 30 and the printing engine. The processor 80 controls the printing engine to create the markings on the printed sheets of media 44. Further, the processor 80 monitors the electric current being supplied to the electrostatic brush 116 and records (in a non-transitory computer storage medium) a current spike pattern of when the electric current exceeds the first current threshold or the current limit.

Figure 7:
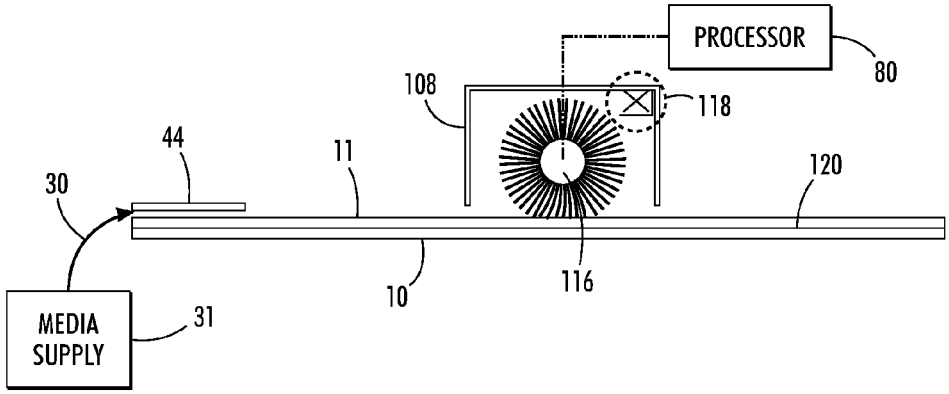
FIG. 7 is a side-view schematic diagram of an electrostatic cleaning device according to embodiments herein.

A short between the conductive fibers or magnetic particles of the electrostatic brush 116 (caused by, for example debris 118 shown in FIG. 7) would not be expected to appear as a current spike, or at least not as a regularly recurring cyclical current spike. The buildup of conductive material 118 between two biased housing surfaces or a biased housing surface and ground would result in a more or less constant high current level. If the conductive material 118 builds up and is subsequently disturbed, the high current may be intermittent, but it will still be more constant than a current spike caused by a photoreceptor scratch.

Figure 8:
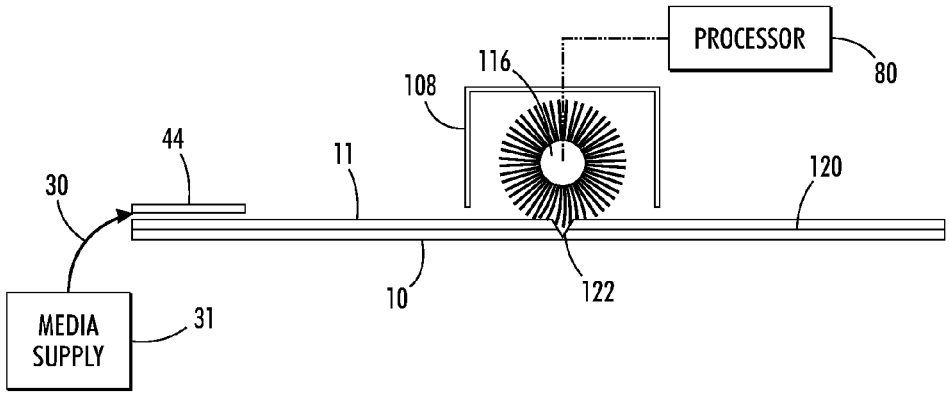
FIG. 8 is a side-view schematic diagram of an electrostatic cleaning device according to embodiments herein.

To the contrary, a photoreceptor scratch 122 (as shown in FIG. 8) allows the fibers of the electrostatic brush 116 to contact the ground plane 120 each time the scratch 122 passes by the electrostatic brush 116 as the photoreceptor 110 cycles around. This produces the regular spiking that is illustrated in, for example, FIG. 2, discussed above.

As noted above, the processor 80 can stop operations of the printing engine if the electric current exceeds the second current threshold (current limit) that is greater than the first current threshold. The processor 80 determines whether a scratch is present on the photoreceptor surface 11 based on the current spike pattern.

Therefore, the embodiments herein use the brush current information to detect deep scratches on a photoreceptor, and to troubleshoot electrical shorts in electrostatic brush cleaner subsystems by distinguishing between photoreceptor scratches and cleaner housing shorting.

The embodiments herein, improves mean time to repair by directing the service person to replace the photoreceptor belt if a scratch is detected, which avoids a lengthy and unnecessary investigation of the cleaner subsystems. Further, the embodiments herein alert the operator to investigate print outputs and stop the print job(s) to prevent unusable prints caused by abrasion or scratching of the photoreceptor belt.

By providing a diagnostic method of identifying photoreceptor scratches and cleaner housing shorting faults, the embodiments herein reduce service time and service costs. Further, photoreceptor scratch detection is achieved prior to the generation of defective prints, so waste associated with discarded prints and reprinting jobs is avoided. Also, with embodiments herein a customer is better able to provide a quality printing job and the printer maintains higher availability due to reduced diagnostic time.

With respect to a multi-function printing device embodiment, more specifically, FIG. 9 illustrates an exemplary electrostatic reproduction machine, for example, a multipass color electrostatic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS).

The ESS is a self-contained, dedicated mini-computer having a central processor unit (CPU), computer readable storage medium (memory), and a display or graphic user interface (GUI) 83. The ESS is the control system which, with the help of sensors 614, and connections 80B as well as a pixel counter 80A, reads, captures, prepares and manages the image data flow between IPU 136 and image input terminal 124. Note that in FIG. 9, not all wiring and connections are illustrated to avoid clutter. In addition, the ESS 80 is the main multi-tasking processor for operating and controlling all of the other machine subsystems and printing operations. These printing operations include imaging, development, sheet delivery and transfer, and particularly control of the sequential transfer assist blade assembly. Such operations also include various functions associated with subsequent finishing processes. Some or all of these subsystems may have micro-controllers that communicate with the ESS 80.

The multipass color electrostatic reproduction machine 180 employs a photoreceptor 10 in the form of a belt having a photoconductive surface layer 11 on an electroconductive substrate. The surface 11 can be made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separation image in a series of parallel scan lines having a certain resolution, generally referred to as lines per inch. Scanning device 24 may include a laser with rotating polygon minor blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pretransfer corotron member negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units thus have their development functions turned off.

During the exposure and development of the last color separation image, for example by the fourth development unit 65, 67 a sheet of support material is advanced to a transfer station JJ by a sheet feeding apparatus 30. During simplex operation (single sided copy), a blank sheet may be fed from tray 15 or tray 17, or a high capacity tray 44 could thereunder, to a registration transport 21, in communication with controller 81, where the sheet is registered in the process and lateral directions, and for skew position. As shown, the tray 44 and each of the other sheet supply sources includes a sheet size sensor 31 that is connected to the controller 80. One skilled in the art will realize that trays 15, 17, and 44 each hold a different sheet type.

The speed of the sheet is adjusted at registration transport 21 so that the sheet arrives at transfer station JJ in synchronization with the composite multicolor image on the surface of photoconductive belt 10. Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

As shown, pretransfer baffles 27 guide the sheet from the registration transport 21 to transfer station JJ. Charge can be placed on the baffles from either the movement of the sheet through the baffles or by the corona generating devices 54, 56 located at marking station or transfer station JJ. Charge limiter 49 located on pretransfer baffles 27 and 48 restricts the amount of electrostatic charge a sheet can place on the baffles 27 thereby reducing image quality problems and shock hazards. The charge can be placed on the baffles from either the movement of the sheet through the baffles or by the corona generating devices 54, 56 located at transfer station JJ. When the charge exceeds a threshold limit, charge limiter 49 discharges the excess to ground.

Transfer station JJ includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10. A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10.

The transfer station JJ also includes a transfer assist blade assembly 200. After transfer, the sheet continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multicolor toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed for example at cleaning station LL using a cleaning brush structure contained in a housing 108.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, non-transitory electronic storage memories (non-transitory storage mediums), wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

monitoring an electric current supplied to an electrostatic brush within a printing device, said electrostatic brush contacting and cleaning a photoreceptor surface within said printing device;

recording a current spike pattern of when said electric current exceeds a first current threshold during said monitoring;

stopping operations of said printing device if said electric current exceeds a second current threshold that is greater than said first current threshold during said monitoring; and determining whether a scratch is present on said photoreceptor surface based on said current spike pattern.

2. The method according to claim 1, said photoreceptor surface comprising an underlying ground plane that conducts said electric current from said electrostatic brush if said scratch is present on said photoreceptor surface.

3. The method according to claim 2, said ground plane conducting said electric current from said electrostatic brush if said scratch extends through said photoreceptor surface to said underlying ground plane.

4. The method according to claim 1, said electrostatic brush comprising electrically conductive brush fibers or electrically conductive magnetic particles connected to a power supply.

5. The method according to claim 4, said monitoring step comprising measuring said electric current supplied by said power supply to said electrically conductive brush fiber or electrically conductive magnetic particles.

6. A method comprising:

monitoring an electric current supplied to an electrostatic brush within a printing device, said electrostatic brush contacting and cleaning a photoreceptor surface within said printing device, and said electrostatic brush being within a cleaner housing;

recording a current spike pattern of when said electric current exceeds a first current threshold during said monitoring;

stopping operations of said printing device if said electric current exceeds a second current threshold that is greater than said first current threshold during said monitoring; and determining whether an electrical short exists between said electrostatic brush and said photoreceptor surface, or whether an electrical short exists between said electrostatic brush and said cleaner housing based on whether said current spike pattern is cyclical or random.

7. The method according to claim 6, said photoreceptor surface comprising an underlying ground plane that conducts said electric current from said electrostatic brush if a scratch is present on said photoreceptor surface.

8. The method according to claim 7, said ground plane conducting said electric current from said electrostatic brush if said scratch extends through said photoreceptor surface to said underlying ground plane.

9. The method according to claim 6, said electrostatic brush comprising electrically conductive brush fibers or electrically conductive magnetic particles connected to a power supply.

10. The method according to claim 9, said monitoring step comprising measuring said electric current supplied by said power supply to said electrically conductive brush fibers or electrically conductive magnetic particles.

11. A method comprising:

monitoring an electric current supplied to an electrostatic brush within a printing device, said electrostatic brush contacting and cleaning a photoreceptor surface within said printing device;

recording a current spike pattern of when said electric current exceeds a first current threshold during said monitoring;

stopping operations of said printing device if said electric current exceeds a second current threshold that is greater than said first current threshold during said monitoring;

determining whether a scratch is present on said photoreceptor surface based on said current spike pattern;

periodically observing print quality if said electric current exceeds said first current threshold; and adjusting said first current threshold depending upon whether said print quality is affected when said electric current exceeds said first current threshold.

12. The method according to claim 11, said photoreceptor surface comprising an underlying ground plane that conducts said electric current from said electrostatic brush if said scratch is present on said photoreceptor surface.

13. The method according to claim 12, said ground plane conducting said electric current from said electrostatic brush if said scratch extends through said photoreceptor surface to said underlying ground plane.

14. The method according to claim 11, said electrostatic brush comprising electrically conductive brush fibers or electrically conductive magnetic particles connected to a power supply.

15. The method according to claim 14, said monitoring step comprising measuring said electric current supplied by said power supply to said electrically conductive brush fibers or electrically conductive magnetic particles.

16. A printing device comprising:

a media supply storing sheets of media;

a media path connected to said media supply;

a printing engine within said media path, said media path supplying said sheets of media from said media supply to said printing engine, said printing engine comprising a photoreceptor having a photoreceptor surface and an electrostatic brush that contacts and cleans said photoreceptor surface;

an output at an end of said media path, printed sheets of media comprising markings generated by said printing engine being delivered from said output; and a processor operatively connected to said media path and said printing engine, said processor controlling said printing engine to create said markings on said printed sheets of media, said processor monitoring an electric current supplied to said electrostatic cleaner, said processor recording a current spike pattern of when said electric current exceeds a first current threshold during said monitoring;

said processor stopping operations of said printing engine if said electric current exceeds a second current threshold that is greater than said first current threshold during said monitoring; and said processor determining whether a scratch is present on said photoreceptor surface based on said current spike pattern.

17. The printing device according to claim 16, said photoreceptor surface comprising an underlying ground plane that conducts said electric current from said electrostatic brush if said scratch is present on said photoreceptor surface.

18. The printing device according to claim 17, said ground plane conducting said electric current from said electrostatic brush if said scratch extends through said photoreceptor surface to said underlying ground plane.

19. The printing device according to claim 16, said electrostatic brush comprising electrically conductive brush fibers or electrically conductive magnetic particles connected to a power supply.

20. The printing device according to claim 19, said monitoring step comprising measuring said electric current supplied by said power supply to said electrically conductive brush fibers or electrically conductive magnetic particles.

* * * * *